United States Patent [19]

Ikuta et al.

[11] 4,282,847

[45] Aug. 11, 1981

[54] EXHAUST GAS RECIRCULATION SYSTEM FOR INTERNAL COMBUSTION ENGINE

[75] Inventors: Yasuhiro Ikuta; Masashi Matsuo, both of Toyota, Japan

[73] Assignee: Toyota Jidosha Kogyo Kabushiki Kaisha, Toyota, Japan

[21] Appl. No.: 74,765

[22] Filed: Sep. 11, 1979

[30] Foreign Application Priority Data

Jul. 31, 1979 [JP] Japan ..... 54-98491

[51] Int. Cl.[3] ..... F02B 47/08

[52] U.S. Cl. ..... 123/568

[58] Field of Search ..... 123/119 A; 125/568

[56] References Cited

U.S. PATENT DOCUMENTS

| | | | |
|---|---|---|---|
| 4,010,723 | 3/1977 | Suziki | 123/119 A |
| 4,112,894 | 9/1978 | Nohira | 123/119 A |
| 4,128,089 | 12/1978 | Takiroto et al. | 123/119 A |

*Primary Examiner*—Wendell E. Burns

*Attorney, Agent, or Firm*—Cushman, Darby & Cushman

[57] ABSTRACT

An exhaust gas recirculation system for an internal combustion engine, having an exhaust gas recirculation passage, a constant pressure chamber disposed at an intermediate portion of the exhaust gas recirculation passage, a pressure regulating valve operative in response to the exhaust gas pressure in the constant pressure chamber, a first flow-rate control valve actuated by vacuum regulated by the pressure regulating valve and adapted to open and close the exhaust gas recirculation passage and a second flow-rate control valve adapted to change the cross-sectional area of the exhaust gas recirculation passage in response to the level of load applied to the internal combustion engine. The exhaust gas recirculation system further has an atmospheric pressure introduction valve communicated with a vacuum passage through which the first flow-rate control valve is communicated with the pressure regulating valve and adapted to selectively introduce the atmospheric pressure into the vacuum passage in accordance with the level of the vacuum established in the intake manifold of the engine.

2 Claims, 2 Drawing Figures

EXHAUST GAS RECIRCULATION SYSTEM FOR INTERNAL COMBUSTION ENGINE

BACKGROUND OF THE INVENTION

The present invention relates to an exhaust gas recirculation system (referred to as "EGR system", hereinafter) and, more particularly, to an improvement in the EGR device having a first flow-rate control valve adapted for opening and closing an EGR passage in accordance with the pressure in a constant pressure chamber disposed in the EGR passage and a second flow-rate control valve adapted to change the cross-sectional area of the EGR passage in accordance with the load applied to the engine.

An EGR system has been known which includes a first and a second flow-rate control valves disposed in the EGR passage for changing the EGR ratio (ratio of flow rate of recirculated exhaust gas to the flow rate of the intake air) so as to effectively suppress the emission of the noxious NOx over the whole range of engine operation and to improve the drivability of the vehicle, as well as to reduce the fuel consumption. In this known system, however, a diaphragm, which defines an exhaust gas pressure chamber of a pressure regulating valve to which the exhaust pressure in the constant pressure chamber is introduced, is inconveniently inversed from the normal set position, when the engine is decelerated from the state of heavy load operation. This undesirable overflexing hinders the required EGR function and seriously deteriorates the durability of the diaphragm.

This undesirable inversion of the diaphragm is attributable to a delay of operation of the first flow-rate control valve due to the length of the vacuum passage between the vacuum chamber of the first flow-rate control valve and the vacuum pick-up port (referred to as EGR port) of the carburetor, and also to the presence of an orifice in the pressure regulating valve disposed in the above-mentioned vacuum passage.

More specifically, for decelerating the engine, the throttle valve of the carburetor, which has been widely opened, is closed almost to the fully closed position. As a result, the pressure at the EGR port is increased to the level of the atmospheric pressure. However, the pressure in the vacuum chamber of the first flow-rate control valve is not increased to the atmospheric pressure immediately after the closing of the throttle valve. Thus, the increase of the pressure in the vacuum chamber of the first flow-rate control valve lags behind the increase of the pressure at the EGR port. Consequently, the closing operation of the first flow-rate control valve is made at a time lag of an order of about 0.5 second. In consequence, a high vacuum of about −600 mmHg in the intake manifold caused by the full closing of the throttle valve is transmitted through the EGR passage and the constant pressure chamber to the diaphragm of the pressure regulating valve to invert the diaphragm.

FIG. 2 shows the characteristics such as the change in pressure in the constant pressure chamber as observed in an engine racing test on an assumption that the engine is decelerated from the state of heavy load operation. More specifically, a full-line curve A shows the change of the vacuum in the intake manifold, while a broken line B shows the change of pressure in the constant pressure chamber.

The hatched region defined by the broken line represents the increase of the vacuum level in the constant pressure chamber which causes the inversion of the diaphragm of the pressure regulating valve. The change of the engine operation speed under the above-mentioned condition is shown by two-dot-and-dash line C.

In order to overcome the above-explained problem of the prior art, it has been attempted to delay the closing of the second flow-rate control valve under the above-stated condition of operation, or to increase the diameter of a fixed restriction or orifice which is disposed in parallel with the second flow-rate control valve, thereby to release the vacuum in the constant pressure chamber, which is represented by the hatched area in FIG. 2, to the exhaust manifold. This measure, however, cannot provide a satisfactory result, although it is effective to lower the peak level of the vacuum by a small extent.

SUMMARY OF THE INVENTION

Under these circumstances, the invention aims at overcoming the above-stated problem of the prior art.

It is, therefore, an object of the invention to prevent the undesirable inversion of the diaphragm of the pressure regulating valve, when the engine is decelerated from the state of heavy load operation, to preserve the correct operation of the EGR system and, at the same time, to improve the durability of the diaphragm, thereby to ensure a stable exhaust gas cleaning function for a long period of time.

To this end, according to the invention, there is provided an EGR system having a first flow-rate control valve which is actuated by a vacuum regulated by a pressure regulating valve which operates in response to the exhaust gas pressure in a constant pressure chamber disposed in the EGR passage, and a second flow-rate control valve adapted to change the cross-sectional area of the EGR passage in response to the load applied to the engine, wherein the improvement comprises an atmospheric-pressure introduction valve communicated with the vacuum passage between the vacuum chamber of the first flow-rate control valve and the pressure regulating valve, the atmospheric-pressure introduction valve being adapted to be actuated by the vacuum established in the intake manifold in such a manner as to introduce the atmospheric air into the vacuum passage in accordance with the increase of the vacuum in the intake manifold vacuum, thereby to prevent the delay of the closing of the first flow-rate control valve.

By providing the atmospheric introduction valve adapted to introduce the atmospheric air in response to the increase of the intake manifold vacuum, in the vacuum passage between the first flow-rate control valve and the pressure regulating valve of the EGR system having the first and the second flow-rate control valves, it is possible to exclude the time lag of the closing of the first flow-rate control valve during the period at which the engine is decelerated from the heavy load operation, thereby to prevent the undesirable inversion of the diaphragm. It is also possible to improve the drivability and fuel consumption during cruising of the vehicle, by diminishing or cutting the exhaust gas recirculation in the light to medium load operation range, through suitably setting the operation pressure of the atmospheric pressure introduction valve.

The above and other objects, as well as advantageous features of the invention will become more clear from the following description of the preferred embodiments taken in conjunction with the accompanying drawings.

DESCRIPTION OF THE PREFERRED EMBODIMENTS

The invention will be more fully understood from the following description.

Figure 1:
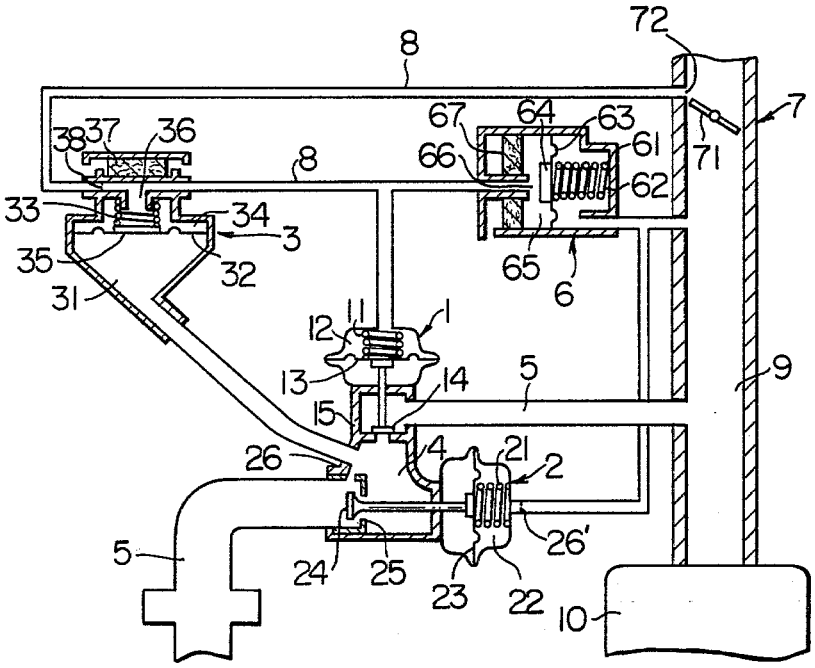
FIG. 1 is a schematic illustration of an EGR system embodying the present invention.

Referring first to FIG. 1 schematically showing an EGR system embodying the present invention, an EGR passage 5 is adapted to recirculate a part of the exhaust gas discharged from an exhaust manifold (not shown) to an intake manifold 9. A constant pressure chamber 4 is disposed at an intermediate part of the EGR passage 5. A first flow-rate control valve 1 is disposed also in the EGR passage 5. This first flow-rate control valve 1 has a vacuum chamber 12 defined partly by a diaphragm 13 which is opposed by a spring 11. The arrangement is such that the diaphragm is deflected to a position where the force of the spring 11 is balanced by the force of the pressure acting on the diaphragm 13, so that a valve member 14 attached to the diaphragm 13 is moved toward and away from a valve seat to control the flow rate of the exhaust gas which is recirculated through the EGR passage 5. A pressure regulating valve 3 is disposed at an intermediate portion of a vacuum passage 8 having a restricting orifice 38 through which the vacuum chamber 12 is communicated with an EGR port 72 of a carburetor 7. The EGR port 72 opens to the inside of the intake bore of the carburetor 7 at a portion of the latter immediately above the throttle valve 71 in the fully closed position. The pressure regulating valve 3 has an exhaust gas pressure chamber 31 defined by a diaphragm 32 and adapted to receive the exhaust gas pressure derived from the above-mentioned constant pressure chamber 4, and an atmospheric chamber 34 accommodating a spring 33 and communicated with the atmosphere through a filter 37.

The arrangement is such that a valve member 35 attached to the diaphragm 32 is moved in response to the change in the level of the exhaust gas pressure chamber 31 to open and close a valve port 36 communicating with the passage 8 between the orifice 38 and the chamber 12 so that the atmospheric air is introduced selectively to regulate the level of the vacuum in the vacuum chamber 12. Thus, the first flow-rate control valve 1 is actuated to vary the opening degree of the valve member 14, by the vacuum the level of which is regulated by the pressure regulating valve 3 which in turn operates in response to the exhaust gas pressure residing in the constant pressure chamber 4. In consequence, the pressure in the constant pressure chamber 4 is maintained substantially at the same level as the atmospheric pressure to permit the recirculation of the exhaust gas at a rate substantially proportional to the flow rate of the intake air through the manifold 9.

A second flow-rate control valve 2 is disposed at the upstream side of the constant pressure chamber 4. This second flow-rate control valve has a vacuum chamber 22 accommodating a spring 21 and partly defined by a diaphragm 23 to which a valve member 24 is attached. The valve member 24 is adapted to cooperate with a valve seat 25. The arrangement is such that the diaphragm 23 is deflected in response to the vacuum applied to the vacuum chamber 22 so that the opening area of the valve seat 25 is changed in inverse proportion to the level of the vacuum applied to the vacuum chamber 22. A fixed orifice 26 is disposed in parallel with the valve seat 25.

Thus, the second flow-rate control valve 2 controls the flow rate of the exhaust gas recirculated to the intake side of the constant pressure chamber 4, by changing the cross-sectional area of the passage 5 which is the sum of the cross-sectional area of the fixed orifice 26 and the cross-sectional area of the opening between the valve member 24 and the valve seat 25 as determined by the position of the valve member 24.

An atmospheric pressure introduction valve 6 is disposed to communicate with that section of the vacuum passage 8 through which the vacuum chamber 12 of the first flow-rate control valve 1 and the pressure regulating valve 3 are communicated with each other. The atmospheric-pressure introduction valve 6 includes a vacuum chamber 62 partly defined by a diaphragm 63 and accommodating a spring 61, and an atmospheric chamber 65 which is communicated with the atmosphere through a filter 67. The vacuum chamber 62 is communicated with the intake manifold 9 downstream of the throttle valve 71. The arrangement is such that the diaphragm 63 is deflected in response to the level of the vacuum applied to the vacuum chamber 62 so that a valve member 64 fixed to the diaphragm 63 is moved toward and away from, to close and open, a valve port 66 communicating the chamber 65 with passage 8 thereby to selectively introduce the atmospheric pressure into the vacuum passage 8. As a result, the atmospheric-pressure introduction valve 6 is actuated to open and close the port 66 in response to the change of vacuum in the intake manifold 9 downstream of the throttle valve 71, which in turn varies depending on the level of the load applied to the engine, thereby to control the operation of the first flow-rate control valve 1.

The EGR system of the invention constructed as above operates in a manner described hereinafter.

During a heavy load operation of the engine in which the throttle valve 71 is largely opened, the level of the vacuum established in the intake manifold 9 is comparatively low, so that the valve member 64 of the atmospheric-pressure introduction valve 6 is biased by the spring 61 to close the atmospheric port 66 to interrupt the admission of atmospheric air into the vacuum passage 8. In this state, the opening degree of the first flow-rate control valve 1 is under the control of the exhaust gas pressure residing in the constant pressure chamber 4, while the opening degree of the second flow-rate control valve 2 is under the control of the vacuum level in the intake manifold 9, so that the exhaust gas is recirculated from the exhaust manifold to the intake manifold at an EGR ratio which is determined in accordance with the level of the load applied to the engine.

As the engine is decelerated from this state by a closing of the throttle valve 71 almost to the fully-closed position, the pressure at the EGR port is increased to the atmospheric pressure, but the transmission of the atmospheric pressure to the vacuum chamber 12 of the first flow-rate control valve 1 is somewhat delayed due to the presence of the restricting orifice 38 in the passage 8.

In the EGR system of the invention, however, the vacuum of the increased level in the intake manifold 9 is applied to the vacuum chamber 62 of the atmospheric-pressure introduction valve member 6. As a result, the valve 64 is moved against the force of the spring 61 to open the atmospheric port 66 to permit the introduction of the atmospheric air into the vacuum passage 8 between the orifice 38 and the first valve 1. Thus, the atmospheric-pressure introduction valve 6 immediately transmits the atmospheric pressure to the vacuum chamber 12 of the first flow-rate control valve 1, thereby to close the first flow-rate control valve without delay.

The vacuum of increased level in the intake manifold 9 is transmitted also to the vacuum chamber 22 of the second flow-rate control valve 2, through the orifice 26 and so forth, so that the valve member 24 is moved in the closing direction to reduce the area of the opening between it and the valve seat 25. However, since the transmission of the high vacuum in the intake manifold is checked by the closing of the first flow-rate control valve, the level of the vacuum in the constant pressure chamber 4 is never raised.

Figure 2:
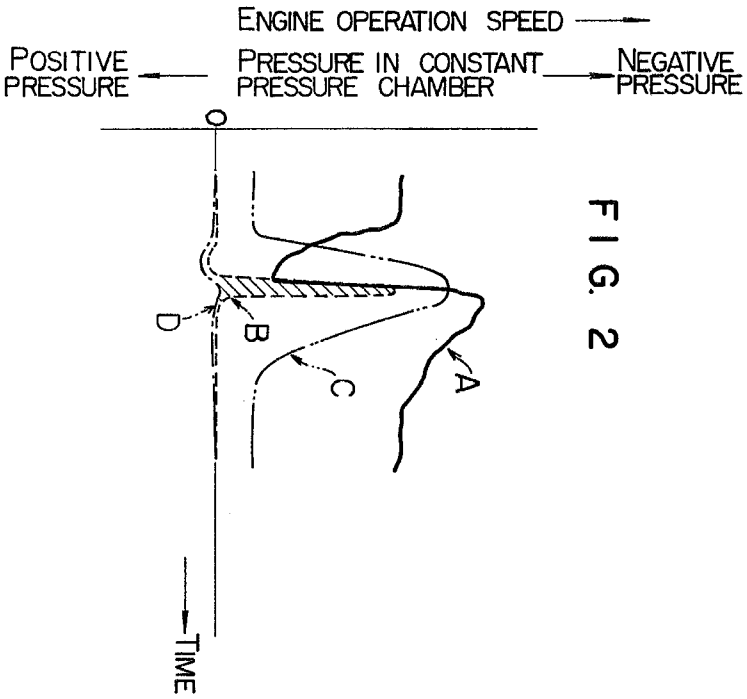
FIG. 2 is a characteristic chart showing the change of the pressure in a constant pressure chamber, as well as the change of the engine speed, as observed in a racing test of an engine.

Referring now to FIG. 2, a one-dot-and-dash line D shows the change of the pressure in the constant pressure chamber 4 of the EGR system in accordance with the present invention. It will be seen that the rise of the vacuum level represented by the aforementioned hatched area is effectively suppressed in the EGR system of this embodiment.

In the described embodiment, the spring 61 of the atmospheric-pressure introduction valve 6 can be set at any desired pressure, in accordance with the level of the vacuum which is established in the intake manifold 9 during deceleration of the engine and which would cause an inversion of the diaphragm 32 of the pressure regulating valve 3.

It is also to be noted that, provided that the set pressure of the spring 61 of the atmospheric pressure introduction valve is selected to fall within the range of between the atmospheric-pressure and a vacuum of order of −360 mmHg, the atmospheric-pressure introduction valve 6 can operate in engine operation modes other than the described mode of deceleration from the heavy load operation. In such a case, it is possible to transmit the atmospheric pressure to the first flow-rate control valve 1 to stop the exhaust gas recirculation even during the light to medium load operation of the engine.

What is claimed is:

1. In an exhaust gas recirculation system for an internal combustion engine having an intake manifold, a throttle valve therein, an exhaust gas recirculation passage communicating with said manifold downstream of said throttle valve, a constant pressure chamber disposed in an intermediate portion of said passage, a first vacuum-actuated flow-rate control valve in said passage downstream of said chamber, a second vacuum-actuated flow-rate control valve in said passage upstream of said chamber for changing the cross-sectional area of said passage, first conduit means communicating the vacuum in said manifold downstream of said throttle valve to said second control valve for actuating the same, second conduit means for communicating the vacuum in said manifold immediately upstream of said throttle valve when closed to said first control valve for actuating the same, a restriction in said second conduit means, and a pressure regulating valve in said second conduit means between said restriction and said first control valve for regulating the vacuum applied thereto in accordance with the exhaust gas pressure in said passage upstream of said first control valve, the improvement comprising:

a vacuum-actuated atmospheric pressure introduction valve communicating with said second conduit means between said pressure regulating valve and said first control valve for introducing atmospheric pressure into said second conduit means; and third conduit means communicating the vacuum in said manifold downstream of said throttle valve with said atmospheric pressure introduction valve for actuating the same.

2. An exhaust gas recirculation system as claimed in claim 1, wherein said atmospheric pressure introduction valve includes a vacuum chamber partly defined by a diaphragm and accommodating a spring acting on said diaphragm, an atmospheric chamber communicated with the atmosphere through a filter and with said second conduit means through a valve port, and a valve member fixed to said diaphragm and adapted to open and close said port as said diaphragm is deflected by the vacuum applied to said vacuum chamber.

* * * * *